US005284492A

United States Patent [19]

Dubin

[11] Patent Number: 5,284,492

[45] Date of Patent: Feb. 8, 1994

[54] ENHANCED LUBRICITY FUEL OIL EMULSIONS

[75] Inventor: Leonard Dubin, Skokie, Ill.

[73] Assignee: Nalco Fuel Tech, Naperville, Ill.

[21] Appl. No.: 958,567

[22] Filed: Oct. 8, 1992

Related U.S. Application Data

[63] Continuation-in-part of Ser. No. 770,979, Oct. 1, 1991.

[51] Int. Cl.[5] ..... C10L 1/18

[52] U.S. Cl. ..... 44/301; 44/302

[58] Field of Search ..... 44/301

[56] References Cited

U.S. PATENT DOCUMENTS

| | | | |
|---|---|---|---|
| 3,180,832 | 4/1965 | Furrey | 252/56 |
| 3,281,358 | 10/1966 | Furrey | 252/34 |
| 3,281,438 | 10/1966 | Johnson | 260/404 |
| 3,287,273 | 11/1966 | Furrey et al. | 252/56 |
| 3,321,404 | 5/1967 | Furrey et al. | 252/51.5 |
| 3,390,083 | 6/1968 | Lion et al. | 252/33.4 |
| 3,399,145 | 8/1968 | Martinek et al. | 252/309 |
| 3,429,817 | 2/1969 | Furrey et al. | 252/56 |
| 3,490,237 | 1/1970 | Lissant | 60/217 |
| 3,637,357 | 1/1972 | Nixon et al. | 44/51 |
| 3,932,476 | 1/1976 | Bergeron | 206/404 |
| 4,017,522 | 4/1977 | Bailey et al. | 260/347.5 |
| 4,083,698 | 4/1978 | Wenzel et al. | 44/51 |
| 4,162,143 | 7/1979 | Yount, III | 44/301 |
| 4,173,455 | 11/1979 | Fodor et al. | 44/301 |
| 4,182,614 | 1/1980 | Moriyama et al. | 44/51 |
| 4,199,326 | 4/1980 | Fung | 44/51 |
| 4,297,107 | 10/1981 | Boehmke | 44/51 |
| 4,378,230 | 3/1983 | Rhee | 44/51 |
| 4,382,802 | 5/1983 | Beinke et al. | 44/301 |
| 4,392,865 | 7/1983 | Grosse et al. | 44/51 |
| 4,666,457 | 5/1987 | Hayes et al. | 44/51 |
| 4,696,638 | 9/1987 | DenHerder | 431/4 |
| 4,725,287 | 2/1988 | Gregoli et al. | 44/51 |
| 4,770,670 | 9/1988 | Hazbun et al. | 44/301 |
| 4,842,616 | 6/1989 | Verhille | 44/51 |
| 5,000,757 | 3/1991 | Puttock et al. | 44/301 |

OTHER PUBLICATIONS

Product Brochure, "Mazer", American Chemical, pp. 32, 33, 72.

Brown, Donald T., Dainoff, Alexander S.; Control of NOx Emissions from Distillate Oil-Fired Gas Turbines; 1991 ASME COGEN-TURBO V., Budapest, Hungary, Sep. 3-5, 1992.

GAF; IGEPAL RC-520; Low-Foaming, Oil-Soluble Nonionic Surfactant; Technical Bulletin 2302-010 (date unknown).

Hilt, M. B., Wasio J.; Evolution of NOx Abatement Techniques Through Combustor Design for Heavy-Duty Gas Turbines; Journal of Engineering for Gas Turbines and Power, Oct. 1964, vol. 106, pp. 825-832.

Leonard, Edward C., ed., The Dimer Acids, Humko Sheffield Chemical, 1975, pp. 50-56 (Date unknown).

Scher, Technical Bulletin; SCHERCOMID SO-A; Bulletin #307-2 Sep., 1983.

Scher, Technical Bulletin; SCHERCOMID ODA, Bulletin #331-1 Aug., 1983.

Union Camp, Chemicals Product Data; UNIDYME 12; Union Camp Corporation, Jacksonville, Fla. (Date unknown).

*Primary Examiner*—Ellen M. McAvoy

*Attorney, Agent, or Firm*—St. Onge Steward Johnston & Reens

[57] ABSTRACT

An improved lubricity water and fuel oil emulsion is presented. The emulsion is used as fuel for an electric power generating turbine, and includes a lubricity additive selected from the group consisting of dimer acids, trimer acids, phosphate esters, sulfurized castor oil, and mixtures thereof. Also included is a method for improving the combustion efficiency of a turbine, using the inventive additives.

25 Claims, No Drawings

ENHANCED LUBRICITY FUEL OIL EMULSIONS

RELATED APPLICATION

This application is a continuation-in-part of copending U.S. patent application entitled "Emulsification System for Light Fuel Oil Emulsions", Ser. No. 7/770,979, now pending, filed in the names of Dubin and Wegrzyn on Oct. 1, 1991, the disclosure of which is incorporated herein by reference.

TECHNICAL FIELD

The present invention relates to a fuel oil composition comprising an emulsion of water and a fuel oil which is used as a combustion fuel for a gas turbine. More particularly, the present invention relates to lubricity agents which can be incorporated in the noted emulsion to permit operation of the gas turbine when firing a water and fuel oil emulsion.

Stationary and mobile combustion units have been identified as sources of nitrogen oxide (NOx, where x is an integer, generally 1 or 2) emissions to the atmosphere. Electric power generating utilities, in fact, have been identified as a prime contributor of NOx emissions. Nitrogen oxides can form from the combustion of organic and inorganic nitrogen compounds in fuel and, at higher temperatures, from thermal oxidation of nitrogen in combustion air. Combustion or gas turbines are considered to be even more prone to the generation of NOx because of the "favorable" high temperature and pressure conditions existing therein, as well as their more oxidative operating conditions.

In addition to use as base load units, gas turbines are often also used by electric power generating utilities for emergency or peak load generation of electricity. Generally, gas turbines can be either industrial units made primarily from steel, or jet airplane engines made primarily from aluminum and aluminum alloys. However, the excessive NOx generation of gas turbines has often prevented their use as base load units because of regulations limiting the amount of nitrogen oxides which can be emitted and resulted in limitation of their use to peak periods or emergencies.

Nitrogen oxides are troublesome pollutants and comprise a major irritant in smog. It is further believed that nitrogen oxides can cause or enhance the process known as photochemical smog formation through a series of reactions in the presence of sunlight and hydrocarbons. Moreover, nitrogen oxides are a significant contributor to acid rain and have been implicated in the undesirable warming of the atmosphere through what is known as the "greenhouse effect" and in the depletion of the ozone layer. In addition, gas turbines often emit a visible plume which is highly undesirable since it causes concern among the general population in areas surrounding the facility.

It is highly desired by electric power generating utilities to be able to operate gas turbines at times other than peak load or on an emergency basis. Doing so would be extremely advantageous for both operational and economic reasons. However, to do so the high NOx emissions generally associated with the gas turbines have to be reduced.

In the past, direct water injection into the combustion chamber of a gas turbine has been utilized to reduce NOx levels by lowering the peak flame temperatures. This was found to be effective at achieving substantial reductions in nitrogen oxides levels. The use of direct water injection, though, has several disadvantages, including water feed rates which can reach 1.5 times the fuel rates or higher, high installation costs, and high energy loss due to cooling. Moreover, the direct addition of water can involve thermal shock, which can cause thermal contraction and cracking of the liners in the combustion box, as well as mechanical and corrosion problems. As a result, the disadvantages of direct water injection often outweigh the benefits of this technique.

Recently, Dainoff, Sprague, and Brown disclosed that the combustion of a water-in-fuel oil emulsion in a gas turbine shows the benefits of water injection without many of the drawbacks. In International Application No. PCT/US92/03328, entitled "Process for Reducing Nitrogen Oxides Emissions and Improving the Combustion Efficiency of a Turbine", they teach the combustion of such emulsions and theorize that the advantages of doing so are created by providing water internal to the flame. This leads to less water being required for superior results to be achieved, which reduces the deleterious effects of directly injecting large amounts of water into the combustion zone of the gas turbine.

In addition, the emulsified fuel was believed to also create a secondary atomization because of the heat of vaporization from the burning fuel, which causes the emulsified water droplets to become steam. This secondary atomization is thought to improve combustion and increase the gas volume. In fact, the heat required to change the water to steam is felt to be the basis for the reduction in flame temperature which leads to reduced formation of nitrogen oxides.

Moreover, a reduced need for a smoke suppressant additive has been found when the disclosed process is practiced because of a significant reduction in particulates emitted by the turbine when a water and fuel oil emulsion is combusted. Furthermore, when compared to separate water injection, the use of the invention of Dainoff/Sprague/Brown has been found to lead to improved engine fuel system integrity and cooler engine burning temperatures (which leads to a reduction in thermal stress). Also, a higher load capacity is believed possible in the gas turbine, and compliance with environmental regulations more easily obtained.

In addition, Brown and Dainoff, in U.S. patent application Ser. No. 07/751,170 entitled "Reducing Nitrogen Oxides Emissions by Dual Fuel Firing of a Turbine", filed Aug. 28, 1991, show that the combustion of a water and fuel oil emulsion with natural gas simultaneously in a turbine will significantly reduce nitrogen oxides levels, below those found for the combustion of natural gas alone. In this mode, a majority of the heat energy (British Thermal Units or BTUs) is provided by the natural gas—even as high as about 90% or higher. The emulsion water provides mass for energy for the turbine, and maintains the flame temperature below the critical temperature for generating NOx. Accordingly, the use of these emulsions can be effective for "correcting" natural gas combusting turbines, as well as those designed to combust an oil alone.

In a development which significantly increased the availability of water and fuel oil emulsions for firing gas turbines either with natural gas or alone, Dubin and Wegrzyn have developed an emulsification system which is surprisingly effective at maintaining water and fuel oil emulsions for extended periods of time. This is especially significant when the gas turbine in question is being used as a peaking or emergency unit, since the emulsion can often sit for extended periods of time with only occasional recirculation. The Dubin/Wegrzyn emulsification system, disclosed in U.S. patent application entitled "Emulsification System for Light Fuel Oil Emulsions", having Ser. No. 07/770,979, filed Oct. 1, 1991, generally comprises an amide, a phenolic surfactant, and, optionally, a difunctional block polymer terminating in a primary hydroxyl group.

Unfortunately, it has been found that combusting a water and fuel oil emulsion in a gas turbine can lead to mechanical problems. These problems are usually caused by the fact that the components of the turbine are designed to operate within the lubricity characteristics of #2 fuel oil. Since a water and fuel oil emulsion has lubricity far less than that of #2 fuel oil, a great deal of damage to the gas turbine components can be caused by combusting a water and fuel oil emulsion in the turbine. Although this problem is apparent in virtually all gas turbines, it is especially significant for turbines having aluminum parts which are more sensitive to damage in this way than steel, especially stainless steel, parts.

What is desired, therefore, is a water and fuel oil emulsion having lubricity characteristics similar to #2 fuel oil, while still providing the benefits of the combustion of a water and fuel oil emulsion.

DISCLOSURE OF INVENTION

The present invention relates to an enhanced lubricity water and fuel oil emulsion for reducing nitrogen oxides emissions and improving combustion efficiency in a stationary, electric power generating source, especially a gas turbine (the term "gas turbine" will be considered to be interchangeable with the term "combustion turbine" for the purposes of this disclosure). In particular, this invention relates to a water and fuel oil emulsion comprising an agent which provides lubricity to the emulsion comparable to that of #2 fuel oil alone. The subject emulsion can be either a water in fuel oil or a fuel oil in water emulsion, although water in fuel oil emulsions are generally preferred for most applications, and can be used as the fuel for a gas turbine.

The oil phase in the inventive emulsions comprises a light fuel oil, by which is meant a fuel oil having little or no aromatic compounds and consists essentially of relatively low molecular weight aliphatic and naphthenic hydrocarbons. The fuel oil can generally be referred to as a light crude naphtha fuel oil. In the refining arts, light crude naphtha refers specifically to the first liquid distillation fraction, which has a boiling range of about 90° F. to about 175° F. This is distinguished from heavy crude naphtha, which is the second distillation fraction, with a boiling range of about 325° F. to about 425° F. "Naphthenic" is an industrial term which refers to fully saturated cyclic hydrocarbons having the general formula $C_nH_{2n}$. "Aliphatic" is an industrial term which refers to fully saturated linear hydrocarbons having the general formula $C_nH_{2n+2}$.

Suitable light fuel oils are those having a viscosity of about 5 SSF to about 125 SSF, preferably about 38 SSF to about 100 SSF, at 100° F. and a specific gravity of about 0.80 to about 0.95 at 77° F. Such fuels include fuels conventionally known as diesel fuel, distillate fuel, #2 oil, or #4 oil, as defined by the American Society of Testing and Measurement (ASTM) standard specification for fuel oils (designation D 396-86). Especially preferred are distillate fuels. Included among these are kerosene (or ASTM grade no. 1 fuel oil) and jet fuels, both commercial and military, commonly referred to as Jet-A, JP-4 and JP-5.

The subject emulsions advantageously comprise water-in-fuel oil emulsions having up to about 90% water by weight. Typically, when the emulsion is to be combusted simultaneously with a natural gas (as is preferred), the emulsion comprises about 60% to about 90% water, more preferably about 70% to about 80% water. The emulsions which have the most practical significance in combustion applications when being combusted alone are those having about 5% to about 50% water and are preferably about 10% to about 35% water-in-fuel oil by weight.

In addition, it is recognized that as the amount of the discontinuous phase (i.e., the water in a water-in-fuel oil emulsion) increases, the possibility of inversion arises. For instance, in an emulsion containing up to about 65% water-in-fuel oil, inversion will cause the emulsion to become a fuel oil-in-water emulsion comprising about 35% of the discontinuous oil phase.

Although this description is written in terms of water-in-fuel oil emulsions, it will be understood to include both fuel oil-in-water and water-in-fuel oil emulsions since they are believed to be equally effective. Moreover, inversion from one to the other may readily occur, so it is not always clear which form of emulsion is present at any given time.

Although demineralized water is not required for the successful control of nitrogen oxides and opacity, the use of demineralized water in the emulsion formed according to the process of this invention is preferred in order to avoid the deposit of minerals from the water on the blades and other internal surfaces of the gas turbine. In this way, turbine life is extended and maintenance and outage time significantly reduced.

The inventive emulsions are prepared such that the discontinuous phase preferably has a particle size wherein at least about 70% of the droplets are below about 5 microns Sauter mean diameter. More preferably, at least about 85%, and most preferably at least about 90%, of the droplets are below about 5 microns Sauter mean diameter for emulsion stability.

Emulsion stability is largely related to droplet size. The primary driving force for emulsion separation is the large energy associated with placing oil molecules in close proximity to water molecules in the form of small droplets. Emulsion breakdown depends on how quickly droplets coalesce. Emulsion stability can be enhanced by the use of surfactants and the like, which act as emulsifiers or emulsion stabilizers. These generally work by forming repulsive layers between droplets, prohibiting coalescence.

The gravitational driving force for phase separation is much more prominent for large droplets, so emulsions containing large droplets separate most rapidly. Smaller droplets also settle, but can be less prone to coalescence, which is the cause of creaming. If droplets are sufficiently small, the force of gravity acting on the droplet is small compared to thermal fluctuations or subtle mechanical agitation forces. In this case the emulsion can become stable almost indefinitely, although given a long enough period of time or a combination of thermal fluctuations these emulsions will eventually separate.

Although it is possible to emulsify the water and light fuel oil and inject directly into the combustion can or other combustion zone, generally it is required that water and light fuel oil emulsions exhibit a high degree of stability. To avoid separation of the emulsion, which can cause slugs of water to be injected through the burner nozzle leading to combustion problems and possible engine damage, an emulsification system is most preferably employed to maintain the emulsion.

A desirable emulsification system which can be utilized comprises about 25% to about 85% by weight of an amide, especially an alkanolamide or n-substituted alkyl amine; about 5% to about 25% by weight of a phenolic surfactant; and about 0% to about 40% by weight of a difunctional block polymer terminating in a primary hydroxyl group. More preferably, the amide comprises about 45% to about 65% of the emulsification system; the phenolic surfactant about 5% to about 15%; and the difunctional block polymer about 30% to about 40% of the emulsification system.

Suitable n-substituted alkyl amines and alkanolamides which can function to stabilize the emulsion of the present invention are those formed by the condensation of, respectively, an alkyl amine and an organic acid or a hydroxyalkyl amine and an organic acid, which is preferably of a length normally associated with fatty acids. They can be mono-, di-, or triethanolamines and include any one or more of the following: oleic diethanolamide, cocamide diethanolamine (DEA), lauramide DEA, polyoxyethylene (POE) cocamide, cocamide monoethanolamine (MEA), POE lauramide DEA, oleamide DEA, linoleamide DEA, stearamide MEA, and oleic triethanolamine, as well as mixtures thereof. Such alkanolamides are commercially available, including those under trade names such as Clindrol 100-0, from Clintwood Chemical Company of Chicago, Ill.; Schercomid ODA, from Scher Chemicals, Inc. of Clifton, N.J.; Schercomid SO-A, also from Scher Chemicals, Inc.; Mazamide ®, and the Mazamide series from PPG-Mazer Products Corp. of Gurnee, Ill.; the Mackamide series from McIntyre Group, Inc. of University Park, Ill.; and the Witcamide series from Witco Chemical Co. of Houston, Tex.

The phenolic surfactant is preferably an ethoxylated alkyl phenol such as an ethoxylated nonylphenol or octylphenol. Especially preferred is ethylene oxide nonylphenol, which is available commercially under the tradename Triton N from Union Carbide Corporation of Danbury, Conn. and Igepal CO from Rhone-Poulenc Company of Wilmington, Del.

The block polymer which is an optional element of the emulsification system advantageously comprises a nonionic, difunctional block polymer which terminates in a primary hydroxyl group and has a molecular weight ranging from about 1,000 to above about 15,000. Such polymers are generally considered to be polyoxyalkylene derivatives of propylene glycol and are commercially available under the tradename Pluronic from BASF-Wyandotte Company of Wyandotte, N.J. Preferred among these polymers are propylene oxide/ethylene oxide block polymers commercially available as Pluronic 17R1.

In addition to the noted components, the emulsification system may further comprise up to about 30% and preferably about 10 to about 25% of a light fuel oil, most preferably the light crude naphtha fuel oil which comprises the continuous phase of the inventive emulsion. It has been found that inclusion of the fuel oil in the emulsification system can in some cases increase emulsion stability of the emulsion itself. In addition, other components such as salts of alkylated sulfates or sulfonates such as sodium lauryl sulfate and alkanolamine sulfonates may also be included in the inventive emulsification system.

The use of the noted emulsification system provides chemical emulsification, which is dependent on hydrophylic-lipophylic balance (HLB), as well as on the chemical nature of the emulsifier. The HLB of an emulsifier is an expression of the balance of the size and strength of the hydrophylic and the lipophylic groups of the composition. The HLB system, which was developed as a guide to emulsifiers by ICI Americas, Inc. of Wilmington, Del., can be determined in a number of ways, most conveniently for the purposes of this invention by the solubility or dispersability characteristics of the emulsifier in water, from no dispersability (HLB range of 1–4) to clear solution (HLB range of 13 or greater).

The emulsifiers useful herein should most preferably have an HLB of 8 or less, meaning that after vigorous agitation they form a milky dispersion in water (HLB range of 6–8), poor dispersion in water (HLB range of 4–6), or show no dispersability in water (HLB range of less than 4). Although the precise explanation is unknown, it is believed that the inventive emulsification system provides superior emulsification because it comprises a plurality of components of different HLB values. Desirably, the emulsification system has a combined HLB of at least about 4.0, more preferably about 5.1 to about 7.0 to achieve this superior emulsification.

For instance, an emulsification system which comprises 70% oleic diethanolamide (average HLB 6), 10% ethylene oxide nonylphenol (average HLB 13), and 20% #2 fuel oil has a combined HLB of about 5.5 (70%×6 plus 10%×13). An emulsification system which comprises 50% oleic diethanolamide, 15% ethylene oxide nonylphenol and 35% of a propylene oxide/ethylene oxide block polymer (average HLB 2.5) has a combined HLB of about 5.8 (50%×6 plus 15%×13 plus 35%×2.5). Such emulsification systems would provide superior emulsification as compared to an emulsifier comprising 80% oleic diethanolamine and 20% #2 fuel oil, which has an HLB of about 4.8 (80%×6).

Desirably, the emulsification system should be present at a level which will ensure effective emulsification. Preferably, the emulsification system is present at a level of at least about 0.05% by weight of the emulsion to do so. Although there is no true upper limit to the amount of the emulsification system which is present, with higher levels leading to greater emulsification and for longer periods, there is generally no need for more than about 5.0% by weight, nor, in fact, more than about 3.0% by weight.

It is also possible to utilize a physical emulsion stabilizer in combination with the emulsification system noted above to maximize the stability of the emulsion. Use of physical stabilizers also provides economic benefits due to their relatively low cost. Although not wishing to be bound by any theory, it is believed that physical stabilizers increase emulsion stability by increasing the viscosity of immiscible phases such that separation of the oil/water interface is retarded. Exemplary of suitable physical stabilizers are waxes, cellulose products, and gums such as whalen gum and xanthan gum.

When utilizing both the emulsification system and physical emulsion stabilizers, the physical stabilizer is present in an amount of about 0.05% to about 5% by weight of the combination of chemical emulsifier and the physical stabilizer. The resulting combination emulsifier/stabilizer can then be used at the same levels noted above for the use of the emulsification system.

The emulsion used in the process of the present invention can be formed using a suitable mechanical emulsifying apparatus which would be familiar to the skilled artisan. Advantageously, the apparatus is an in-line emulsifying device for most efficiency. The emulsion is formed by feeding both the water and the fuel oil in the desired proportions to the emulsifying apparatus, and the emulsification system can either be admixed or dispersed into one or both of the components before emulsification or can be added to the emulsion after it is formed.

It has now surprisingly been found that the addition of a component selected from the group consisting of dimer and/or trimer acids, sulfurized castor oil, phosphate esters, and mixtures thereof will significantly increase the lubricity of the subject water and fuel oil emulsions and avoid the mechanical problems associated with such emulsions when combusted in a gas turbine. Most preferred among these are the dimer and/or trimer acids or blends thereof.

Dimer acids are high molecular weight dibasic acids produced by the dimerization of unsaturated fatty acids at mid-molecule and usually contain 21-36 carbons. Similarly, trimer acids contain three carboxyl groups and usually 54 carbons. Dimer and trimer acids are generally made by a Diels Alder reaction. This usually involves the reaction of an unsaturated fatty acid with another polyunsaturated fatty acid—typically linoleic acid. Starting raw materials usually include tall oil fatty acids. In addition, it is also known to form dimer and trimer acids by reacting acrylic acid with polyunsaturated fatty acids.

After the reaction, the product usually comprises a small amount of monomer units, dimer acid, trimer acid, and higher analogs. Where the product desired is primarily dimer acid (i.e., at least about 85% dimer acid), the reactant product is often merely referred to as dimer acid. However, the individual components can be separated to provide a more pure form of dimer acid or trimer acid by itself.

Suitable dimer acids for use in this invention include Westvaco Diacid 1550, commercially available from Westvaco Chemicals of Charleston Heights, S.C.; Unidyme 12 and Unidyme 14, commercially available from Union Camp Corporation of Dover, Ohio; Empol 1022, commercially available from Henkel Corporation of Cincinnati, Ohio; and Hystrene 3695, commercially available from Witco Co. of Memphis, Tenn.

In addition, blends of dimer and trimer acids can also be used as the lubricity additive of the present invention. These blends can be formed by combining dimer and trimer acids, or can comprise the reaction product from the formation of the dimer acid, which can contain substantial amounts of trimer acid. Generally, blends comprise about 5% to about 80% dimer acid. Specific blends include a blend of about 75% dimer acid and about 25% trimer acid, commercially available as Hystrene 3675, a blend of 40% dimer acid and 60% trimer acid, commercially available as Hystrene 5460, and a blend of about 60% dimer acid and about 40% trimer acid, all commercially available from Witco Co. of Memphis, Tenn.

Phosphate esters useful as the lubricity additive of the present invention can be prepared by phosphorylation of aliphatic and aromatic ethoxylates. These phosphate esters can be hydrophylic or lipophylic and include phosphate esters of fatty alcohol ethoxylates. Suitable phosphate esters are commercially available as Antara LB700, a hydrophylic phosphate ester and Antara LB400, a lipophylic phosphate ester, both of which are commercially available from Rhone-Poulenc Co. of Cranbury, N.J. The sulfurized castor oil which may be used in the present invention is commercially available as Actrasol C-75 from Climax Performance Materials Corporation Co. of Summit, Ill.

As noted above, the use of dimer or trimer acids is highly preferred as the lubricity additive of the present invention, as compared to phosphate esters or sulfurized castor oil. This is because the combustion of emulsions using the dimer and/or trimer acid lubricity additives produce less ash, with less than about 0.2% ash being highly preferred. In addition, the elimination of phosphorous and sulfur compounds is also desired. The use of phosphorous- or sulfur-containing lubricity additives can lead to colored deposits on the turbine nozzle guide vanes and other turbine blades which can hinder efficient operation of the turbines and result in low electrical energy output. Although it is not clear how the use of phosphorous or sulfur compounds can lead to these deposits, it is possible they act as binders. In any case, non-phosphorous and non-sulfur lubricity additives are preferred.

The lubricity agent provided in the noted emulsions should be present at a level which varies between about 50 and about 550 parts per million (ppm) in the emulsion. Most preferably, the lubricity additive is present at levels of about 100 to about 400 ppm. At these levels, emulsions of up to about 85% water-in-fuel oil or as low as about 15% fuel oil-in-water will exhibit lubricities comparable to those of fuel oil alone.

Most advantageously, when an emulsification system is employed to maintain emulsion stability, the lubricity agent is incorporated into the emulsification system and applied to the emulsion in this manner. The lubricity agent should be present in the emulsification system, which when applied at a level of about 1500 to about 3500 ppm, more advantageously about 2500 to about 3000 ppm, ensures the desired level of lubricity agent is present in the final emulsion.

Interestingly, the lubricity gains provided by the inventive lubricity additive are relatively specific to fuel oil and water emulsions. In tests on fuel oil alone, and water alone, no significant increases in lubricity have been noted, yet incorporation of the inventive lubricity additives in a fuel oil and water emulsion creates significant increases in the lubricity of the emulsion. In fact, when added to fuel oil and water emulsions, the lubricity additives increase the emulsion lubricity to levels equivalent to those for fuel oil alone.

Since most feed lines for a gas turbine are designed with the intent that they be exposed only to a non-aqueous environment, it is also desirable to incorporate a corrosion inhibitor with the lubricity additives of the present invention. Suitable corrosion preventing additives include filming amines, such as organic, ethoxylated amines. Among these are N,N',N'-tris (2-hydroxyethyl)-N-tallow-1,3-diaminopropane, commercially available as Ethoduomeen T/13 from Akzo Chemicals, Incorporated of Chicago, Ill.; an oleic diethanolamide which is the reaction product of methyl oleate and diethanolamine; an alkanolamide commercially available as Mackamide MO from McIntyre Co. of Chicago, Ill.; and Ethoduomeen T/25, which is a higher ethoxylated version of Ethoduomeen T/13.

In addition to use as the sole fuel for a gas turbine, the emulsions prepared with the lubricity additives of the present invention can advantageously be used in a gas turbine which primarily fires natural gas, such as is taught by Brown and Sprague in U.S. patent application Ser. No. 07/751,170, entitled "Reducing Nitrogen Oxides Emission by Dual Fuel Firing of a Turbine", filed Aug. 8, 1991, the disclosure of which is incorporated herein by reference. In fact, such a "dual fuel" use is preferred.

By use of a manifold which permits the dual injection of both natural gas and the inventive emulsion, it has been found that the nitrogen oxides content of the effluent can be substantially reduced when compared with the effluent when natural gas is fired alone. Although not fully understood, it is believed that the addition of the emulsion permits firing at a lower flame temperature due to the water introduction, without the disadvantages of direct water injection into the combustion can.

The following examples further illustrate and explain the invention, but are not considered limiting.

EXAMPLE 1

The lubricity of water and fuel oil emulsions is tested using a Falex Lubricant Tester. The procedure used is based on ASTM standard method D2670-88. In the test, steel 1037 alloy V-blocks are used with 5052 alloy aluminum test pins. Evaluations are performed in duplicate and average results reported. In the case of inconsistent results, a triplicate test is performed. Test pins are cleaned, weighed, and saved in plastic bags. Acceptable performance is defined as passing 500 psi pressure for 5 minutes.

The data is presented in terms of metal loss (grams/hour), total running time (seconds), and a Wear Index which provides wear increments at 250 psi, 500 psi, and 750 psi. The Wear Index is presented in the format A/B(B)/Cx, where A represents increments to maintain 250 psi, B represents total increments from beginning of test through 500 psi, (B) represents increments to maintain 500 psi, and C represents total increments from beginning of test to failure as marked by the x.

The individual runs made include

Controls

Run 1—#2 fuel oil.

Run 2—80% water-in-#2 fuel oil.

Run 3—70% water-in-#2 fuel oil.

Performance Tests

Run 4—70% water-in-#2 fuel oil, further containing 200 ppm of Westvaco Diacid 1550 dimer acid.

Run 5—80% water-in-#2 fuel oil, further containing 200 ppm Westvaco Diacid 1550 dimer acid.

Run 6—70% water-in-#2 fuel oil, further containing 200 ppm phosphate ester.

Run 7—70% water-in-#2 fuel oil, further containing 400 ppm of sulphurized castor oil.

Run 8—#2 fuel oil containing 200 ppm Westvaco Diacid 1550 dimer acid.

Run 9—water containing 200 ppm Westvaco Diacid 1550 dimer acid.

The results of these tests are set out in Table 1.

TABLE 1

| Run | Metal Loss (gm/hr) | Total Running Time (Seconds) | Cumulative Total (Maintenance) Increments through 250/500/750 psi (Index of Wear) |
|---|---|---|---|
| 1* | 0.52 | 678 | 20/271(124)351/x |
| 2 | 4.23 | 41 | 93x/---/-- (Massive Failure) |
| 3 | | MASSIVE FAILURE | |
| 4 | 0.15 | 630 | 5/158(31)/305x |
| 5 | 0.20 | 621 | 12/165(32)/266x |
| 6 | 0.18 | 700 | 8/92(12)/360x |
| 7 | 0.15 | 630 | 9/152(35)/334x |
| 8 | 0.53 | 652 | 37/282(125)507x |
| 9 | | MASSIVE FAILURE | |

*Performance standard

EXAMPLE 2

The procedure of Example 1 is followed using an emulsion comprising 70% water in #2 fuel oil having lubricity additives set out below. The runs made are as Run 1—100% #2 fuel oil as control.

Run 2—200 ppm Westvaco Diacid 1550 dimer acid and 200 ppm Ethoduomeen T/13.

Run 3—400 ppm sulfurized castor oil and 400 ppm Ethoduomeen T/13.

Run 4—200 ppm of a blend of 40% dimer acid and 60% trimer acid, and 0.02% Ethoduomeen T/13.

Run 5—400 ppm Unidyme 12 dimer acid and 400 ppm Ethoduomeen T/13.

Run 6—200 ppm Antara LB400 lipophyllic phosphate ester.

Run 7—200 ppm of Hystrene 3675, a blend of 75% dimer acid and 25% trimer acid and 200 ppm Ethoduomeen T/13.

Run 8—400 ppm Westvaco Diacid 1550 dimer acid and 200 ppm Ethoduomeen T/13.

Run 9—400 ppm Unidyme 12 dimer acid and 400 ppm Ethoduomeen T/13.

Run 10—400 ppm Unidyme 12 dimer acid.

Run 11—500 ppm Antara LB700 hydrophyllic phosphate ester.

Run 12—400 ppm sulfurized castor oil and 200 ppm Ethoduomeen T/13.

Run 13—400 ppm Westvaco Diacid 1550 dimer acid.

Run 14—300 ppm of Hystrene 5460 a blend of 40% dimer acid and 60% trimer acid and 100 ppm Ethoduomeen T/13.

Run 15—400 ppm Westvaco Diacid 1550 dimer acid and 400 ppm Ethoduomeen T/13.

Run 16—400 ppm sulfurized castor oil.

Run 17—100 ppm of Hystrene 5460 trimer acid and 100 ppm Ethoduomeen T/13.

Run 18—200 ppm sulfurized castor oil and 200 ppm Ethoduomeen T/13.

Run 19—400 ppm sulfurized lard oil.

Run 20—400 ppm polyacrylic acid.

Run 21—800 ppm Ethoduomeen T/13.

Run 22—800 ppm Witcamide 511 alkanolamide.

Run 23—2000 ppm Witcamide 511.

Run 24—800 ppm Witconol 14 polyglycerol ester of oleic acid.

Run 25—800 ppm Duomeen C, N-coco-1,3-diaminopropane.

Run 26—800 ppm Polyamine HPA, a complex mixture of ethyleneamines commercially available from Union Carbide Co. of Danbury, Conn.

Run 27—400 ppm Duomeen C and 200 ppm Dowanol DB, diethyleneglycolmonobutylether.

Run 28—400 ppm ethoxylated castor oil.

Run 29—400 ppm Witcamide 511.

Run 30—400 ppm Ethoduomeen T/13.

Run 31—400 ppm Ethoduomeen T/25.

Run 32—400 ppm ethoxylated castor oil and 200 ppm Dowanol EB.

Run 33—400 ppm ethoxylated castor oil and 200 ppm #2 fuel oil.

Run 34—400 ppm ethoxylated castor oil, 400 ppm #2 fuel oil, and 400 ppm Dowanol EB, 2-butoxyethanol/ethyleneglycolbutylether.

Run 35—400 ppm Witcamide 511, 400 ppm #2 fuel oil, and 400 ppm Dowanol EB.

Run 36—400 ppm Ethoduomeen T/13, 400 ppm #2 fuel oil, and 400 ppm Dowanol EB.

Run 37—400 ppm Ethoduomeen T/25, 400 ppm #2 fuel oil, and 400 ppm Dowanol EB.

Run 38—400 ppm Ucon LB525 polypropylene glycol derivative of butanol.

Run 39—400 ppm Ucon EPML-X, metal working lubricant containing polyalkylene-glycol and diethanolamine, commercially available from Union Carbide Co. of Danbury, Conn.

Run 40—400 ppm Triton RW50 nitrogen containing surfactant, 400 ppm #2 fuel oil, and 400 ppm Dowanol EB.

The results are set out in Table 2.

TABLE 2

| Run | Average Metal Loss gm/hr | Average Total Running Time (seconds) | Average Cumulative Increments Through 250/500/750 psi |
|---|---|---|---|
| 1 | 0.52 | 678 | 20/271/351X |
| 2 | 0.15 | 630 | 5/158/305X |
| 3 | 0.15 | 634 | 9/152/334X |
| 4 | 0.16 | 680 | 8/152/300X |
| 5 | 0.17 | 634 | 5/148/315X |
| 6 | 0.18 | 743 (630) | 8/92/360(PF)*X |
| 7 | 0.18 | 628 | 4/152/282X |
| 8 | 0.19 | 672 | 5/155/450X |
| 9 | 0.19 | 642 | 11/150/340X |
| 10 | 0.21 | 825 | 5/152/572X |
| 11 | 0.21 | 625 | 49/229/391x |
| 12 | 0.21 | 592 (PF)* | 5/168X(PF)*/- |
| 13 | 0.23 | 669 | 8/162/380X |
| 14 | 0.26 | 627 | 9/162/285X |
| 15 | 0.27 | 630 | 12/200/352X |
| 16 | 0.38 | 665 | 12/202/428X |
| 17 | 0.46 | 514 (PF)* | 30/235(PF)310X |
| 18 | | MASSIVE FAILURE | |
| 19 | | MASSIVE FAILURE | |
| 20 | | MASSIVE FAILURE | |
| 21 | | MASSIVE FAILURE | |
| 22 | | MASSIVE FAILURE | |
| 23 | | MASSIVE FAILURE | |
| 24 | | MASSIVE FAILURE | |
| 25 | | MASSIVE FAILURE | |
| 26 | | MASSIVE FAILURE | |
| 27 | | MASSIVE FAILURE | |
| 28 | | MASSIVE FAILURE | |
| 29 | | MASSIVE FAILURE | |
| 30 | | MASSIVE FAILURE | |
| 31 | | MASSIVE FAILURE | |
| 32 | | MASSIVE FAILURE | |
| 33 | | MASSIVE FAILURE | |
| 34 | | MASSIVE FAILURE | |
| 35 | | MASSIVE FAILURE | |
| 36 | | MASSIVE FAILURE | |
| 37 | | MASSIVE FAILURE | |
| 38 | | MASSIVE FAILURE | |
| 39 | | MASSIVE FAILURE | |
| 40 | | MASSIVE FAILURE | |

*PF = partial failure

It can be seen from the examples herein that the use of the inventive lubricity additives increase the lubricity of a water and fuel oil emulsion to levels approximating those for #2 fuel oil alone. In addition, compositions outside of the defined inventive compositions do not provide significant lubricity increases to a water and fuel oil emulsion, and typically result in massive failure. Interestingly, it can be seen that the addition of the inventive lubricity agents to #2 fuel oil or water alone does not have a substantial effect on the lubricity thereof, certainly not the same effect as the inventive lubricity additives have on a water and fuel oil emulsion.

The above description is for the purpose of teaching the person of ordinary skill in the art how to practice the present invention, and it is not intended to detail all of those obvious modifications and variations of it which will become apparent to the skilled worker upon reading the description. It is intended, however, that all such obvious modifications and variations be included within the scope of the present invention, which is defined by the following claims.

I claim:

1. An improved lubricity water and fuel oil emulsion for use as fuel for an electric power generating turbine, comprising a lubricity additive selected from the group consisting of dimer acids, trimer acids, sulfurized castor oil, and mixtures thereof.

2. The emulsion of claim 1, wherein said lubricity additive is present at a level of at least about 100 ppm.

3. The emulsion of claim 2, wherein said lubricity additive comprises dimer acids, trimer acids, or blends thereof.

4. The emulsion of claim 1, wherein said lubricity additive further comprises a corrosion inhibitor comprising a filming amine.

5. The emulsion of claim 1, which further comprises an emulsification system comprising:

a) about 25% to about 85% of an amide;

b) about 5% to about 25% of a phenolic surfactant; and c) about 0% to about 40% of a difunctional block polymer terminating in a primary hydroxyl group.

6. The emulsion of claim 5, wherein said amide comprises an alkanolamide formed by condensation of a hydroxyalkyl amine with an organic acid.

7. The emulsion of claim 5, wherein said phenolic surfactant comprises an ethoxylated alkylphenol.

8. The emulsion of claim 7, wherein said ethoxylated alkylphenol comprises ethylene oxide nonylphenyl.

9. The emulsion of claim 5, wherein said difunctional block polymer comprises propylene oxide/ethylene oxide block polymer.

10. The emulsion of claim 5, wherein said emulsification system is present in an amount of about 0.05% to about 5.0% by weight.

11. The emulsion of claim 1, wherein said fuel comprises #2 oil, kerosene, jet fuels, diesel fuels and mixtures thereof.

12. The emulsion of claim 1, which comprises up to about 90% water.

13. A method for improving the combustion efficiency of an electric power generating turbine, comprising forming an emulsion of water and fuel oil, which comprises a lubricity additive selected from the group consisting of dimer acids, trimer acids, sulfurized castor oil and mixtures thereof; and combusting said emulsion in an electric power generating turbine.

14. The method of claim 13, wherein said lubricity additive is present at a level of at least about 100 ppm.

15. The method of claim 13, wherein said lubricity additive comprises dimer acids, trimer acids, or blends thereof.

16. The method of claim 13, wherein said lubricity additive further comprises a corrosion inhibitor comprising a filming amine.

17. The method of claim 13, which further comprises an emulsification system comprising:

a) about 25% to about 85% of an amide;

b) about 5% to about 25% of a phenolic surfactant; and c) about 0% to about 40% of a difunctional block polymer terminating in a primary hydroxyl group.

18. The method of claim 17, wherein said amide comprises an alkanolamide formed by condensation of a hydroxyalkyl amine with an organic acid.

19. The method of claim 17, wherein said phenolic surfactant comprises an ethoxylated alkylphenol.

20. The method of claim 19, wherein said ethoxylated alkylphenol comprises ethylene oxide nonylphenyl.

21. The method of claim 17, wherein said difunctional block polymer comprises propylene oxide/ethylene oxide block polymer.

22. The method of claim 17, wherein said emulsification system is present in an amount of about 0.05% to about 5.0% by weight.

23. The method of claim 13, wherein said fuel oil comprises #2 oil, kerosene, jet fuels, diesel fuels and mixtures thereof.

24. The method of claim 13, which comprises up to about 90% water-in-fuel oil.

25. The method of claim 13, wherein said emulsion is combusted simultaneously with natural gas.

* * * * *

UNITED STATES PATENT AND TRADEMARK OFFICE

CERTIFICATE OF CORRECTION

PATENT NO. : 5,284,492

DATED : Feb. 8, 1994

INVENTOR(S) : Leonard Dubin

It is certified that error appears in the above-indentified patent and that said Letters Patent is hereby corrected as shown below:

At column 9, line 11, "Aug. 8, 1991" should read --August 28, 1991--

At column 10, line 22, insert --follows:-- immediately after "The runs made are as".

Signed and Sealed this

Fifth Day of July, 1994

Bruce Lehman

*Attest:*

BRUCE LEHMAN

*Attesting Officer*

*Commissioner of Patents and Trademarks*